United States Patent [19]

Olmedo et al.

[11] Patent Number: 5,036,759

[45] Date of Patent: Aug. 6, 1991

[54] INSTALLATION FOR PRINTING FABRIC PIECES

[75] Inventors: Antonio P. Olmedo, Sentmenat; Fernando O. Fernández, Sabadell, both of Spain

[73] Assignee: Gali Internacional, S.A., Barcelona, Spain

[21] Appl. No.: 606,740

[22] Filed: Oct. 24, 1990

[30] Foreign Application Priority Data

Nov. 2, 1989 [ES] Spain ..... 8903704

[51] Int. Cl.[5] ..... B41F 15/08

[52] U.S. Cl. ..... 101/114; 101/116; 101/118; 101/121; 101/126; 198/750

[58] Field of Search ..... 101/114, 112, 116, 118, 101/121, 122, 126; 198/750

[56] References Cited

U.S. PATENT DOCUMENTS

| | | | |
|---|---|---|---|
| 2,959,122 | 11/1960 | Masson | 101/126 |
| 3,420,167 | 1/1969 | van der Winden | 101/116 |
| 3,572,240 | 3/1971 | Böhm | 101/116 |
| 3,638,564 | 2/1972 | Prange et al. | 101/35 |
| 3,719,141 | 3/1973 | Jaffa et al. | 101/126 |
| 3,774,534 | 11/1973 | Ichinose | 101/119 |
| 4,029,201 | 6/1977 | Davis | 198/750 |
| 4,238,999 | 12/1980 | Giani et al. | 101/116 |

FOREIGN PATENT DOCUMENTS

| | | | |
|---|---|---|---|
| 1415683 | 11/1975 | United Kingdom | 198/750 |

*Primary Examiner*—Edgar S. Burr
*Assistant Examiner*—E. P. Raciti
*Attorney, Agent, or Firm*—McAulay Fisher Nissen Goldberg & Kiel

[57] ABSTRACT

An installation for printing fabric pieces having: a fixed printing frame; two take-up drums, situated spaced apart from and facing the terminal edges of the frame, each drum having a horizontal rotary shaft; drive means for causing said drums to rotate; a printing band as a support for the fabric piece to be printed and which is provided with end portions attached to the take-up drums and adapted to slide over the horizontal surface, alternately between a position of maximum take-up on the first drum and a position of maximum take-up on the second drum.

12 Claims, 4 Drawing Sheets

FIG. 2
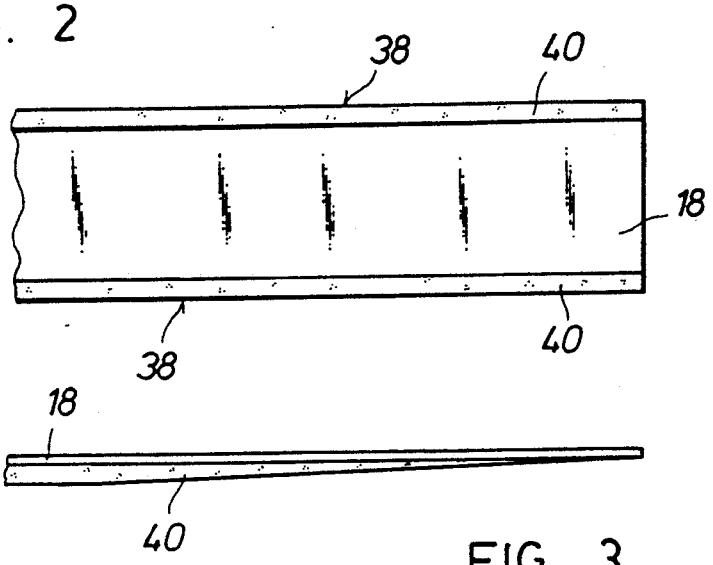
FIG. 3
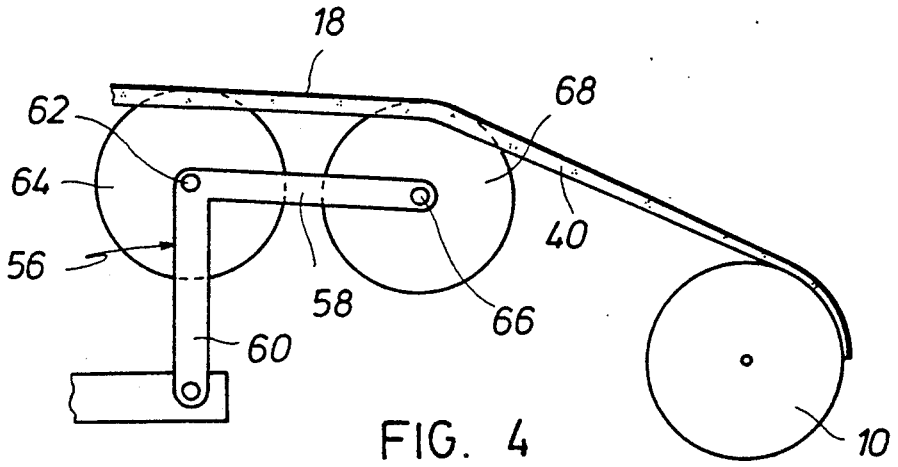
FIG. 4
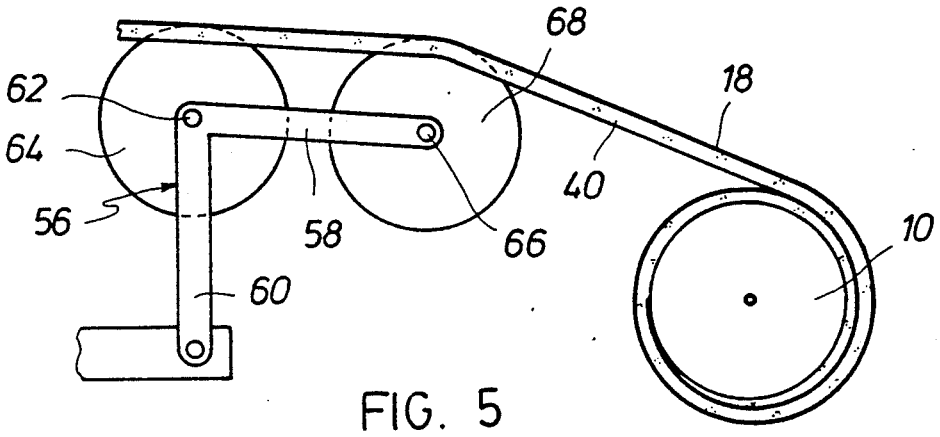
FIG. 5

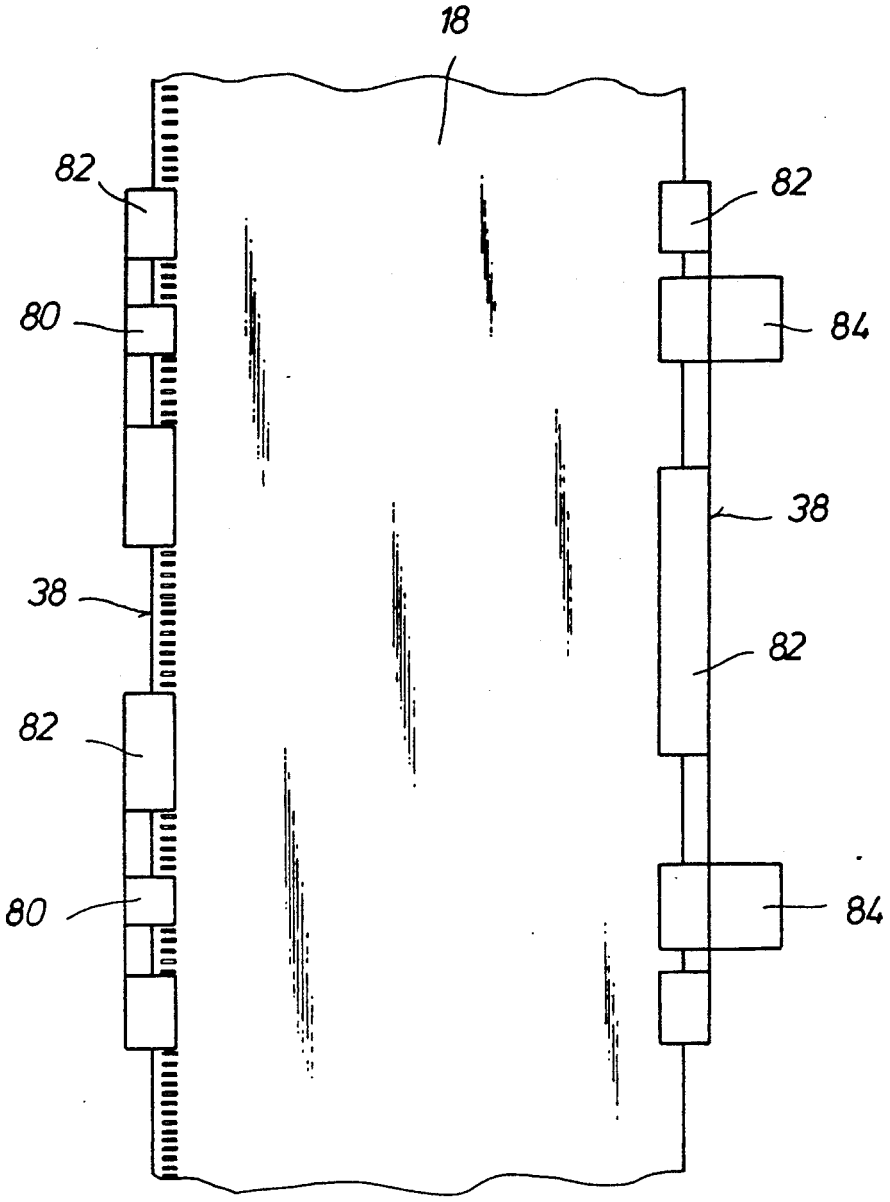
FIG. 8
FIG. 9
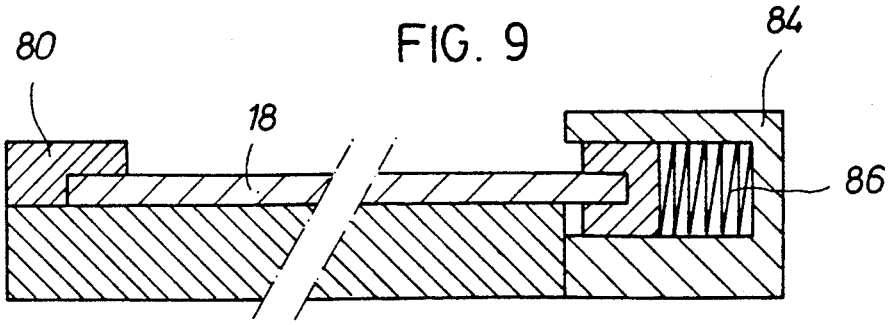

INSTALLATION FOR PRINTING FABRIC PIECES

BACKGROUND OF THE INVENTION

1. Field of the Invention

The invention relates to an installation for printing fabric pieces, having a fixed printing frame provided with a horizontal upper surface extending longitudinally between first and second terminal edges.

2. Description of the Prior Art

In the textile finishing process, printing is usually the last stage, conferring the highest degree of design on the fabric, with a high added value. A very wide range of processes and equipment are used for printing and extend from the completely artisanal ones to the most automated, using modern technologies. Generally speaking, it may be said that the more exclusive a design is and the better the fabric to be printed is, more artisanal is the process used.

From a quantitative point of view, the major portion of fabrics printed around the world are done on so-called flat machines, in the case of intermediate yardages and qualities, rotary block machines for high yardages and transfer machines for very high yardages, specific textile materials and a limited range of designs. Long table printing would be in the last place with regard to yardage printed at world level, although it would be at an intermediate level with regard to billing volume, because of its high added value.

Currently, the greater demand for quality products and exclusive designs from the users is a fact in all fields, particularly in dress and decoration. The machinery and equipment used in the production of these goods must be adapted to the new situation to attend to the demand while maintaining or increasing its profitability.

In spite of the increasing demand by the users for exclusive, top-quality printed fabrics, the growth of the long table printing segment is hindered by the technical limitations of the process which, in spite of increasing automation, has achieved relatively low productivity gradients. To this, there is to be added the large space occupied by this equipment, the length of which must be equal to the length of the piece it is wanted to print, normally from 45 to 85 meters, with serious repercussions in view of the growing cost of industrial floor space.

SUMMARY OF THE INVENTION

It is an object of the invention to provide a printing installation in which the above mentioned drawback of the large floor space required is eliminated while maintaining high quality levels.

This object is attained with an installation of the type first mentioned above and comprising a first and a second take-up drum, separated from said frame and situated respectively facing said first and second terminal edges, each of said drums being provided with a rotary shaft, both shafts being horizontal, mutually parallel and at a lower level than said horizontal surface; rotary drive means for said drums; a printing band adapted to become a support for the fabric piece to be printed, said band having a first and a second end portion respectively attached to said first and second take-up drums and being adapted to slide longitudinally on said horizontal surface, moving alternately between a first position of maximum take-up on the first drum and a second position of maximum take-up on the second drum, said band also having longitudinal edges on each of which there is located a strip of elastomeric material, providing a spacing between successive coils on wind-up; and a tensioning system for the printing band comprising a first and a second unit, each of which is located between a take-up drum and a terminal edge of the fixed frame.

As may be appreciated, the invention provides a compact, highly automated piece of printing equipment, integrating the whole process.

Unlike the long table printing in which the fabric is static supported by a table, it being the block holding equipment which moves, the invention contemplates that it is the fabric, supported on a printing carrier band, which feeds forward and is placed below the fixed printing module. The key to the proposed installation is to be found in the helical fabric take-up device, such that the printed surface of the fabric will be protected from any physical contact, which would cause stains and the colour to run. In this way, the installation is very compact and will occupy a very small space.

BRIEF DESCRIPTION OF THE DRAWING

Further advantages and features of the invention will be appreciated from the following description in which one preferred embodiment of the invention is given without any limiting nature and with reference to the accompanying drawings. In the drawings:

FIG. 2 is a plan view from below of a terminal portion of the printing band, showing the elastomeric strips.

FIG. 3 is a side elevation view of the said terminal portion.

FIG. 4 is a schematic view of a terminal portion of the printing band, from one unit of the tensioning system, in the minimum take-up position of the band on one of the drums.

FIG. 5 is a view similar to the previous one, corresponding to an intermediate take-up position of the band on the drum.

FIG. 8 is a schematic plan view from above of a portion of the printing band placed in the frame; and FIG. 9 is schematic transverse cut-away portion of the said portion and of the frame.

DETAILED DESCRIPTION OF THE INVENTION

Figure 1:
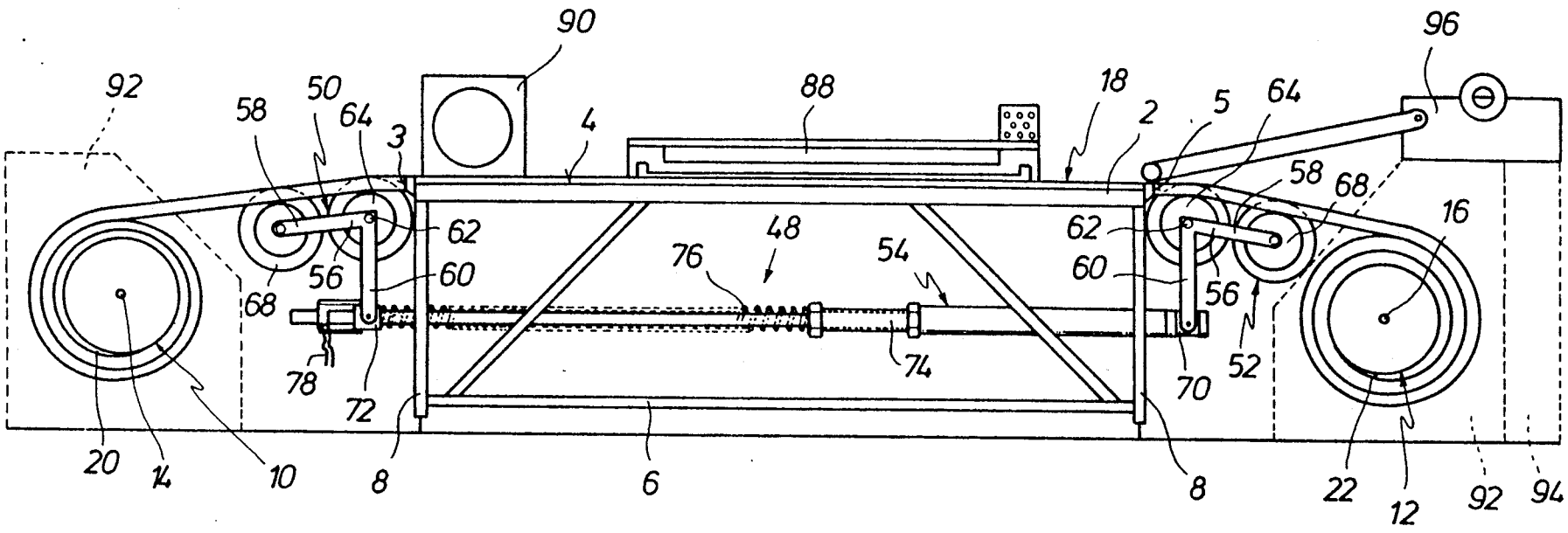
FIG. 1 is a schematic side elevation view of the installation of the invention.

The installation of the invention is provided with a fixed frame 2 having a perfectly flat, horizontal upper surface 4 which is rigid like a drawing marble table in a mechanical workshop. Said surface stretches longitudinally between a first and a second terminal edges 3 and 5. The frame 2 is supported in a conventional rigid structure 6 by way of adjustable legs 8 allowing the fixed frame 2 to be appropriately levelled.

At a certain distance from the terminal edges 3 and 5 there are respectively a first take-up drum 10 and a second take-up drum 12, the holding and support means of which have been omitted from the drawings. Each of the drums is provided with a shaft 14, 16, both shafts being horizontal, mutually parallel and generally orthogonal relative to the longitudinal orientation of the frame 2. In other words, the shafts 14, 16 are disposed generally parallel to the terminal edges 3 and 5. It is also stated that said shafts are at a substantially lower level than the horizontal surface 4. Further mention will be made of the drums hereinafter.

A printing band 18 is the most important member of the present installation. The band is preferably made from steel sheet having a thickness preferably lying between 0.8 and 1.2 mm and the purpose thereof is to support the fabric to be printed, it being possible optionally to join the band 18 and the fabric together by an appropriate adhesive. If necessary, the band is coated with a resin to improve the performance of the adhesive.

The printing band 18 is connected at first and second terminal portions 20, 22 thereof to the respective take-up drums 10, 12 and extends from one drum to the other, usually forming coils and having always a portion supported on the surface 4 of the fixed frame 2. The band may slide on said surface and is adapted to move between a first maximum take-up position on the first drum 10 and a second maximum take-up position on the second drum 12. A maximum take-up position on one drum obviously implies a minimum take-up position on the other drum. In certain cases, the movement of the band 18 may be limited so that one or both of the maximum positions are not reached.

The printing operations take place when the printing band 18, with the fabric duly adhered thereto, is on the fixed frame 2, since the band must always be supported on a flat surface when it is off the take-up drums and at the same time it is accessible to the operator, since otherwise bulges might be caused on the surface thereof, making it practically useless for its function.

The band 18 is caused to slide by the rotation of the drums 10, 12. The said drums, as stated above, comprise a shaft 14 (FIG. 6) running on support bearings 24 (of which only one has been shown), further bearings 26, Seeger rings 28, spacer rings 30 and seals 32. At least two identical wheels 34 are mounted on the shaft 14 and the band 18 is engaged on the cylindrical surface 36 thereof to form the corresponding roll.

It is to be appreciated (FIGS. 2 to 7), that the printing band 18 is provided with longitudinal edges 38 on each of which there is a strip 40 of elastomeric material acting as a spacer between the successive wraps, in such a way that between two immediately adjacent wraps there is an air chamber 41 protecting the fabric from any physical contact. The frame is provided with appropriate grooves to receive the strips 40, so that the movement of the band 18 is not hindered nor are the strips damaged.

Figure 6:
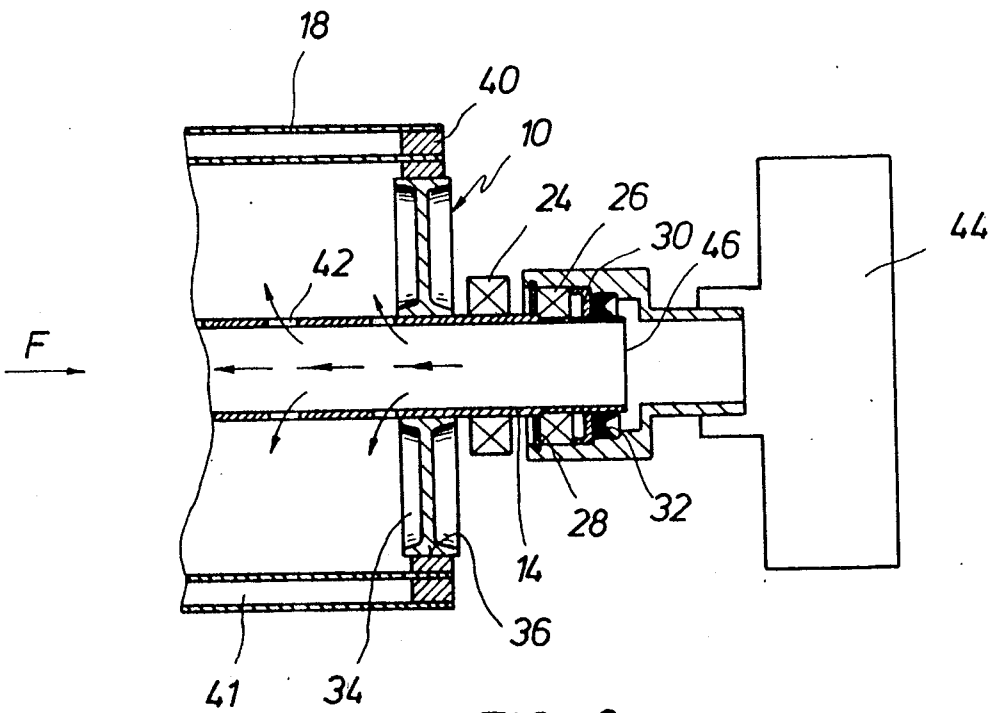
FIG. 6 is a partial schematic view on an axial plane of a drum showing two wound coils of the printing band.

The first drum 10 is caused to rotate by a main motor and a reduction gear (not shown) which would drive the end of the shaft 14 not shown in FIG. 6. In turn, the second drum 12 is caused to rotate by a follower motor and a further reduction gear (not shown either). These motors are preferably d.c. electric motors and the synchronous operation thereof is discussed hereinafter.

The shafts 14, 16 of each drum is hollow and, furthermore, is provided with lateral orifices 42. Said shaft is connected to a source of hot air shown schematically in FIG. 6 under reference numeral 44. This source may be drier specially designed for the printing installation or it may be derived from a possibly pre-existing drying arrangement.

Figure 7:
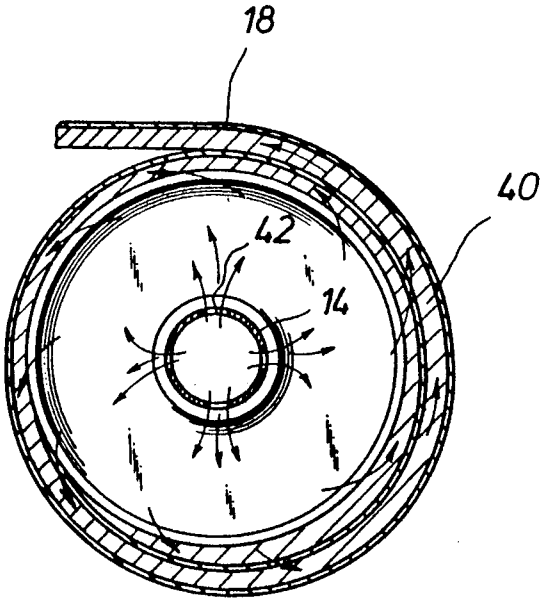
FIG. 7 is a view in the direction of the arrow F of FIG. 6.

The hot air from the drier follows pathways shown schematically by the arrows in FIGS. 6 and 7. The air enters in the shaft through the port 46 thereof, flows through the lateral orifices and through the air chambers 41 formed by the wraps of the band 18, so as to reach all the fabric wound up with the band 18.

Independently of the above, there is an important aspect to be borne in mind in the driving of the printing band 18, such as is the minimum radius of curvature admitted by the metal sheet to avoid tearing or permanent deformation. This aspect is taken into account in the design of the drums 10, 12 and the edges of the support surfaces.

Between the frame 2 and each of the drums 10, 12, there are portions in which the printing band is not supported from below. it should be appreciated that in these portions, the slope of the band 18 varies depending on the number of wraps of the coil, the slope logically diminishing as the overall dimension of the take-up increases. The invention contemplates that in all cases, even in the maximum take up dimension, there be a slight downward slope of the band from the bed to the roll, to ensure correct engagement of the band to the upper surface 4 of the frame 2.

The printing band 18 needs to be under tension within a preset range along the whole of the development thereof. Therefore, a tensioning system 48 comprising a first unit 50 and a second unit 52, connected together by a tensioning bar has been devised. Each unit 50, 52 comprises a pair of rightangled bars 56, having a support arm 58 and a tensioning arm 60. Across the apexes of one same pair of rightangled bars 56, there is a fixed shaft 62 on which a first roller 64 is mounted and a shaft 66 on which a second roller 68 may rotate is mounted across the ends of the support arms 58. In turn, the tensioning arms 60 of both units are hingedly connected to the tensioning bar 54.

The tensioning bar 54 is adjustable and is formed by guide 70 fixed with regard to the tensioning bar itself and which is hingedly connected to the tensioning sioning arms 60 of the second unit 52. At the other end there is a sliding guide 72 which, in turn, is hingedly connected to the tensioning arms 60 of the first unit 50. An adjusting bolt 74 is located at an intermediate portion of the tensioning bar 54 and between the bolt and the sliding guide 72 there is a compression spring 76 preventing the sliding guide 72 and the adjusting bolt 74 from moving towards each other. Finally, there is an electronic sensor 78 detecting the movements of the sliding guide 72 in both directions.

When the main motor is set running to drive the first drum 10, the printing band 18 is caused to move and there is, logically, a change in the tension thereof. If this change occurs in one direction, the spring 76 is compressed, since the tensioning arms 60 of the first unit 50 rock slightly towards the second unit 52. Said change causes a relative movement between the tensioning bar 54 and the sliding guide 72 and this movement is detected by the electronic sensor 78, which generates an electrical voltage proportional to the movement. This voltage acts as a control and feedback signal for the follower motor of the second drum 12. If the band 18 tension change were in the second direction, thereby causing the spring 76 to be decompressed, the sensor 78 would produce another voltage which would be a control and feedback signal for the follower motor, which would react to hold the printing band 18 tension constant.

Three factors have a decisive influence on the quality of the printing: the accuracy of positioning of the printing band, the guiding of the band to obtain absolutely linear movements and a perfect flatness of the band in the area where the printing is effected.

To achieve absolutely linear movements, it is necessary for at least one of the edges 38 of the band to be made with strict alignment tolerances. The edge 38 will be guided by two lateral guideways 80 situated on the frame 2 (See FIGS. 8 and 9). The contact of the said edge with the guideways by respective shoes 84 urged by springs 86 or cylinders situated on the opposite edge to the one in question.

The required flatness in the printing area is ensured with the strict manufacturing tolerances of the strip used as printing band and with the extreme flatness with which the printing bed is made. Lateral guideways 82 for the printing band will also limit the possibility of the edges lifting.

The installation is suitable for comprising also a flat printing module 88 and a rotary printing module 90, the description of which is omitted since they are conventional. There is also contemplated the existence of drying chambers 92, a scouring module 94 and a fabric spreader take-up device 96.

What we claim is:

1. An installation for printing fabric pieces, having a fixed printing frame provided with a horizontal upper surface extending longitudinally between first and second terminal edges comprising a first and a second take-up drum, spaced apart from said frame and situated respectively facing said first and second terminal edges, each of said drums being provided with a rotary shaft, both shafts being horizontal, mutually parallel and at a lower level than said horizontal surface; rotary drive means for said drums; a printing band adapted to become a support for the fabric piece to be printed, said band having a first and a second end portion respectively attached to said first and second take-up drums and being adapted to slide longitudinally on said horizontal surface, moving alternately between a first position of maximum take-up on the first drum and a second position of maximum take-up on the second drum, said band also having longitudinal edges on each of which there is located a strip of elastomeric material, providing a spacing between successive coils on wind-up; and a tensioning system for the printing band comprising a first and a second unit, each of which is located between a take-up drum and a terminal edge of the fixed frame.

2. The installation of claim 1, wherein at least one of the take-up drums is formed by a hollow shaft provided with lateral orifices, there being at least two wheels of equal diameter mounted on said hollow shaft.

3. The installation of claim 2, wherein said hollow shaft is provided with an end port which is in communication with a source of hot air.

4. The installation of claim 1, wherein said printing band is made of steel coil.

5. The installation of claim 4, wherein said printing band has a thickness lying between 0.8 and 1.2 mm.

6. The installation of claim 1, wherein each unit of the tensioning system comprises: a first roller mounted on a fixed rotation shaft; two rightangled bars capable of rocking about said fixed shaft and provided with respective support arms and respective tensioning arms; and a second roller mounted on a shaft suspended between said support arms; and wherein there is an adjustable tensioning bar connecting the tensioning arms of both units together.

7. The installation of claim 1, wherein said rotary drive means are a main motor driving said first drum and a follower motor driving said second drum, to maintain the tension in the band constant.

8. The installation of claim 7, wherein said motors are d.c. electric motors.

9. The installation of claim 6, wherein said adjustable tensioning bar comprises: a guide fixed relative to the tensioning arm and hingedly connected to the tensioning arms of the second unit of the tensioning system; an adjusting screw, a guide sliding along a portion of the bar and hingedly attached to the tensioning arms of the first unit of the tensioning system; a compression spring extending between the adjusting screw and the sliding guide urging the screw and sliding guide apart; and an electronic sensor responding to the movement of the sliding guide relative to the bar.

10. The installation of claim 9, wherein the sliding guide slides relative to the bar and said sliding generates a voltage in the electronic sensor, said voltage being a control and feedback signal for the follower motor.

11. The installation of claim 1, being provided with a flat printing module and a rotary printing module.

12. The installation of claim 1, wherein at least one of the edges of the printing band defines a straight alignment, there being mounted on the bench lateral guideways adapted to be in permanent contact with said straight alignment edge, as well as shoes adapted to urge said band against said guideways.

* * * * *